US005211711A

United States Patent [19]

Marco

[11] Patent Number: 5,211,711

[45] Date of Patent: May 18, 1993

[54] PACKAGE COMPRISING MULTIPLE CONTAINERS, SUCH AS BEVERAGE CANS, AND METHOD OF FORMING PACKAGES

[75] Inventor: Leslie S. Marco, Bloomingdale, Ill.

[73] Assignee: Illinois Tool Works Inc., Glenview, Ill.

[21] Appl. No.: 891,400

[22] Filed: May 29, 1992

[51] Int. Cl.[5] ..... B26D 3/08

[52] U.S. Cl. ..... 83/862; 53/48.4; 83/39; 83/300; 206/150

[58] Field of Search ..... 83/331, 39, 34.1, 861, 83/862, 300; 53/48.4, 48.3, 48.1; 206/150

[56] References Cited

U.S. PATENT DOCUMENTS

| | | | |
|---|---|---|---|
| 2,519,409 | 8/1950 | Strassenburg | 83/862 |
| 2,552,353 | 5/1951 | Troth et al. | 83/862 X |
| 2,997,169 | 8/1961 | Poupitch | 206/65 |
| 3,086,651 | 4/1963 | Poupitch | 206/65 |
| 3,204,386 | 9/1965 | Creed et al. | 53/48 |
| 3,383,828 | 5/1968 | Cunningham | 53/35 |
| 3,504,790 | 4/1970 | Owen | 206/65 |
| 3,778,096 | 12/1973 | Smith | 294/87.2 |
| 3,816,968 | 6/1974 | Morgan et al. | 53/48 |
| 3,830,361 | 8/1974 | Klygis | 206/150 |
| 3,991,640 | 11/1976 | Schlueter | 83/341 |
| 4,064,989 | 12/1977 | Olsen | 206/428 |
| 5,020,661 | 6/1991 | Marco | 206/150 |
| 5,115,910 | 5/1992 | Klygis | 206/150 |

*Primary Examiner*—Douglas D. Watts
*Assistant Examiner*—Kenneth E. Peterson
*Attorney, Agent, or Firm*—Dressler, Goldsmith, Shore, Stuker & Milnamow, Ltd.

[57] ABSTRACT

A package of substantially identical containers, such as beverage cans, and a carrier and a method of making such packages are disclosed. The carrier has band segments defining container-receiving apertures and additional apertures. The carrier is applied so that the containers are received in the container-receiving apertures and so that the band segments engage cylindrical side walls of the containers. Among the band segments, terminal cross segments define opposite ends of the carrier and medial cross segments separate the container-receiving apertures in each longitudinal row. Each medial cross segment is severed partially, for a substantial distance along its transverse midline, from one of the opposite edges of the carrier, toward one of the additional apertures and has at least one secondary slit extending transversely between the transverse midline and one of the container-receiving apertures.

5 Claims, 3 Drawing Sheets

PACKAGE COMPRISING MULTIPLE CONTAINERS, SUCH AS BEVERAGE CANS, AND METHOD OF FORMING PACKAGES

TECHNICAL FIELD OF THE INVENTION

This invention pertains to a package comprising substantially identical containers, such as beverage cans, and a carrier formed from a single sheet of resilient polymeric material Certain cross segments of the carrier are severed partially along their transverse midlines to facilitate removal of individual containers. This invention pertains also to a method of forming such packages.

BACKGROUND OF THE INVENTION

Typically, carrier stock having band segments defining container-receiving apertures for machine application to substantially identical containers is formed, as by die cutting, from a single sheet of resilient polymeric material. After the carrier stock has been applied so that the containers are received in the container-receiving apertures, individual packages may be then formed by severing such stock transversely along certain of its band segments.

Each package formed thereby has a given number of the containers, e.g. six, eight, or twelve containers, in two or three longitudinal rows, along with an individual carrier severed from the carrier stock. Commonly, the containers are beverage cans, such as soft drink or beer cans.

Apparatus useful in applying such stock to such containers and in severing such stock to form such packages are disclosed in Creed et al. U.S. Pat. No. 3,204,386, Cunningham U.S. Pat. No. 3,383,828, Morgan U.S. Pat. No. 3,816,968,and Schlueter U.S. Pat. No. 3,991,640.

As disclosed in the Creed et al. patent (see FIG. 34) and in the Schlueter patent (see FIGS. 2 and 5), the band segments to be transversely severed to form individual packages are severed via knives mounted operatively in knife assemblies, on star wheels. The knives are arranged to be transversely reciprocated.

It is known to provide such stock with tear-open capability A recent example of such carrier stock formed with tear-open tabs is disclosed in Marco U.S. Pat. No. 5,020,661. An earlier example thereof is disclosed in Olsen U.S. Pat. No. 4,064,989.

As disclosed Klygis et al. U.S. Pat. No. 5,115,910, such carrier stock has tear-open capability relying upon tear-open band segments, rather than upon tear-open tabs. Specifically, a cross segment of the carrier stock has primary and secondary slits and frangible bridges in an arrangement such that a tear propagates wholly within the cross segment having such slits and bridges, into one of the container-receiving apertures.

Other arrangements of slots provided in such carrier stock to facilitate separation of individual packages are exemplified in Cunningham U.S. Pat. No. 3,383,828, supra, Smith U.S. Pat. No. 3,778,096, and Klygis U.S. Pat. No. 3,830,361.

Other arrangements of slots provided in such carrier stock to facilitate removal of individual containers are exemplified in Poupitch U.S. Pat. No. 2,997,169, Poupitch U.S. Pat. No. 3,086,651, and Owen U.S. Pat. No. 3,504,790.

This invention is addressed to improvements in a package comprising substantially identical containers, such as beverage cans, and such a carrier.

SUMMARY OF THE INVENTION

This invention provides a novel package comprising a plurality of substantially identical containers having cylindrical side walls and a carrier formed from a single sheet of resilient polymeric material. The novel package has tear-initiating slits, as described below, which facilitate container removal.

The carrier has band segments defining container-receiving apertures in a rectangular array comprising longitudinal rows and transverse ranks. The band segments defining additional apertures separate from the container-receiving apertures. The carrier, which has two opposite edges, is applied so that the containers are received in the container-receiving apertures and so that the band segments engage the cylindrical side walls of the containers. The segments comprise outer segments extending in a generally longitudinal direction, inner segments extending in a generally longitudinal direction, and cross segments extending in a generally transverse direction. The cross segments comprise terminal cross segments defining opposite ends of the carrier and medial cross segments separating the container-receiving apertures in each longitudinal row along the opposite edges of the carrier. Each of the medial cross segments has a transverse midline.

In the novel package, each medial cross segment has a tear-initiating slit extending from one of the opposite edges of the carrier, for a substantial distance along the transverse midline of such medial cross segment. Preferably, the tear-initiating slit of each medial cross segment extends over approximately one third to approximately one half of the transverse midline. Each medial cross segment has a secondary slit spaced from the tear-initiating slit and located between the transverse midline and one of the container-receiving apertures.

This invention also provides a novel method of forming packages from such containers and from carrier stock formed from a single sheet of resilient polymeric material. The carrier stock, which has two opposite edges, is severable transversely to form individual carriers Each carrier is similar to the carrier described in the penultimate paragraph above and has similar band segments The containers are arranged in a rectangular array comprising longitudinal rows and transverse ranks. The carrier stock is applied to the containers so that the containers are received in the container-receiving apertures and so that the band segments engage the cylindrical side walls of the containers.

In the novel method, each terminal cross segment at one end of one such carrier is severed completely along its transverse midline, each medial cross segment of the same carrier is severed partially along its transverse midline, and each terminal cross segment at the other end of such carrier is severed along its medial cross segment.

Preferably, the cross segments noted in the preceding paragraph are severed sequentially, as recited. Preferably, each medial cross segment is severed so that the tear-initiating slit of such medial cross segment extends over approximately one half of the transverse midline of such medial cross segment.

Severing of the terminal cross segments and severing of the medial cross segments may be advantageously effected by moving knives transversely so as to cut into the carrier stock, from the opposite edges, toward the additional apertures.

These and other objects, features, and advantages of this invention are evident from the following description of a preferred embodiment of this invention with reference to the accompanying drawings.

DETAILED DESCRIPTION OF PREFERRED EMBODIMENT

Figure 1:
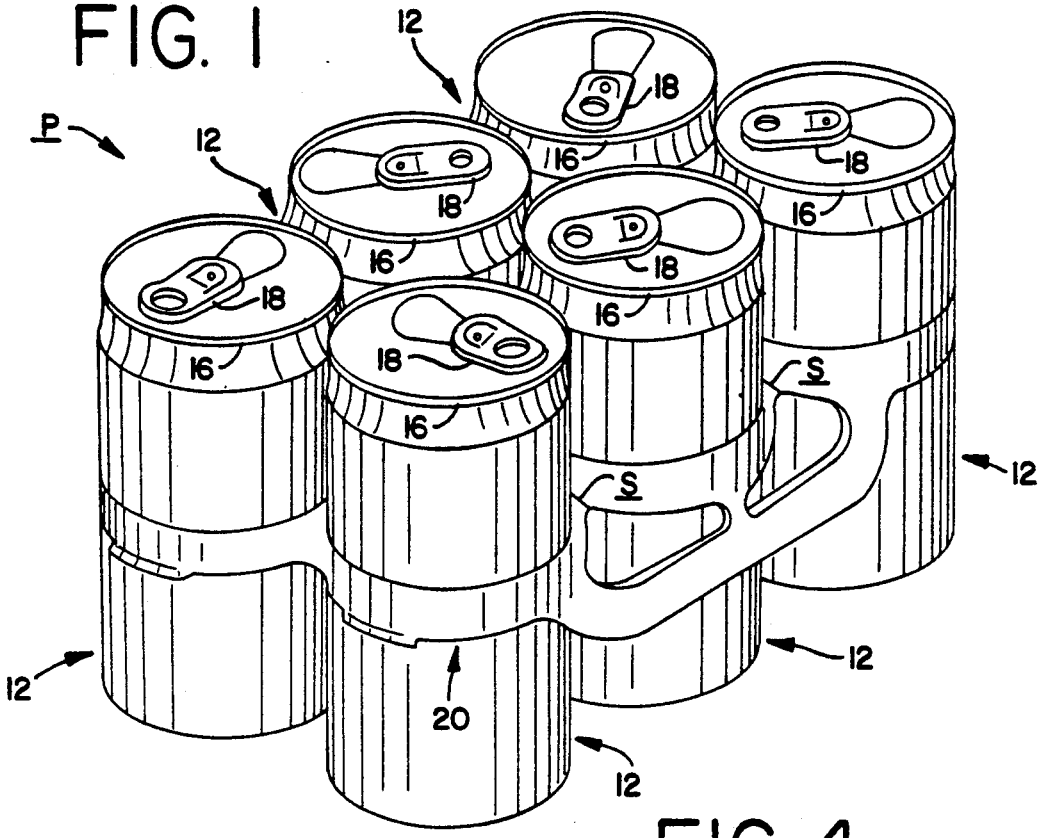
FIG. 1 is a perspective view of a package comprising six beverage cans and a carrier and embodying this invention.

As shown in FIG. 1, a novel package P constituting a preferred embodiment of this invention comprises a carrier 20 and six substantially identical containers 12, each being received in a container-receiving aperture 14 of the carrier 20. According to this invention, certain band segments of the carrier 20 are severed partially, so as to enable some of the containers 12 to be easily removed from the carrier 14.

Figure 5:
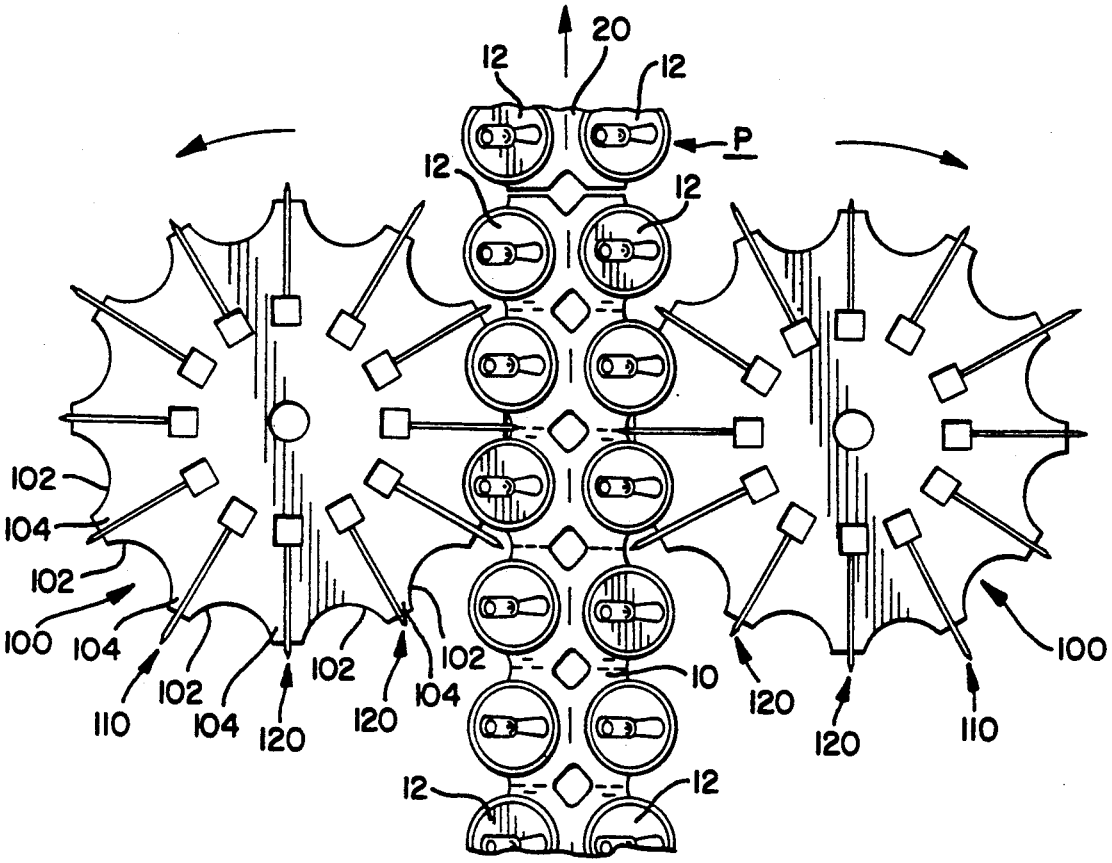
FIG. 5 is a fragmentary, plan view of two rows of such cans, the carrier stock applied to such cans, and certain elements of apparatus used to sever certain cross segments of the carrier stock for purposes of this invention.
Figure 6:
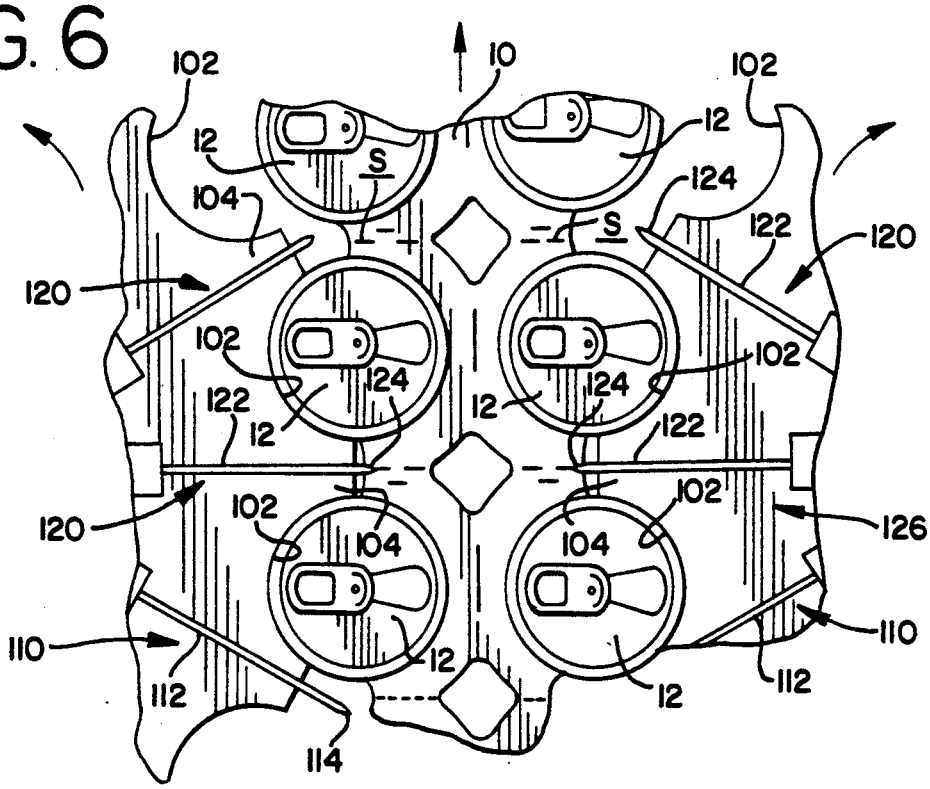
FIG. 6 is an enlarged detail taken from FIG. 5.

As shown in FIG. 1, the containers 12 are beverage cans of a type used commonly for beer, soft drinks, and other beverages. Also, each container 12 has a chime 16 at one end, which is provided with a pull tab 18. Two longitudinal rows of such containers 12 are shown in FIGS. 5 and 6. This invention is not limited, however, to usage with beverage cans of the type noted above but is useful with cans, bottles, and other containers of various types.

Figure 2:
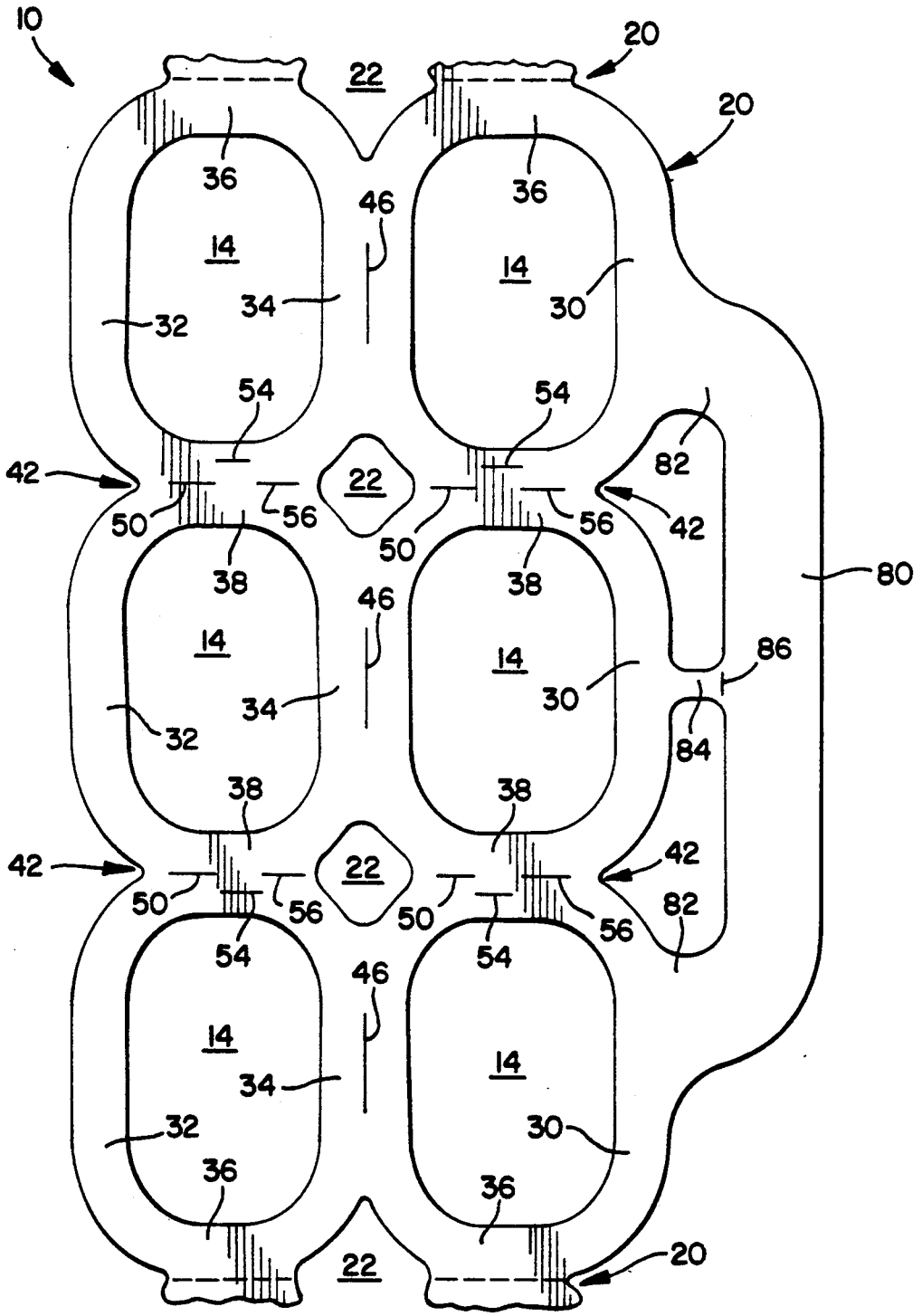
FIG. 2 is a fragmentary, plan view of carrier stock comprising the carrier used in the package shown in FIG. 1.

As shown in FIG. 2, the carrier 20 is formed as one of a series of similar carriers severable from carrier stock 10 formed in an indeterminate length, as by die-cutting, from a single sheet of resilient polymeric material. A preferred material for the carrier stock 10 is low density polyethylene. A preferred thickness for such stock 10 in an unstressed 110 condition, if low density polyethylene is used, is about 14 mils.

The carrier stock 10 is formed, for each individual carrier 20, with integrally joined band segments defining six separate, substantially rectangular, container-receiving apertures 14, along with two additional, smaller apertures 22. As shown in FIG. 2, the container-receiving apertures 14 are in a rectangular array with longitudinal rows and transverse ranks, namely two longitudinal rows and three transverse ranks for each carrier 20. Each of the smaller apertures 22 is disposed amid four container-receiving apertures 14.

Preferably, as shown in FIG. 1, the carrier stock 10 is applied to the side walls of the respective containers 12, away from the chime 16 of each container 12, between the upper and lower ends of such container 12. Accordingly, it is possible to manipulate two adjacent containers 12 by separating their lower ends manually while using their upper ends as a fulcrum where their upper ends abut near their chimes 16, so as to stress the carrier 20 at the band segments between the adjacent containers 12. Alternatively, it is possible to manipulate two adjacent containers 12 by separating their upper ends manually, so as to stress the carrier 20 at the band segments between the adjacent containers 12.

As shown in FIG. 2, the band segments for each carrier 20 comprise three outer segments 30 at a handle edge of such carrier 20, three outer segments 32 at an opposite edge of such carrier 20, three inner segments 34 between the outer segments 30 and the outer segments 32, two cross segments 36 at each of the opposite ends of such carrier 20, and two cross segments 38 in each of two transverse regions between the cross segments 36 at such ends.

The outer segments 30, 32, at the respective edges of such carrier 20 and the inner segments 34 therebetween extend in a generally longitudinal direction when the carrier stock 10 is unstressed. The cross segments 36 at the opposite ends of such carrier 20 and the cross segments 38 located therebetween extend in a generally transverse direction when the carrier stock 10 is unstressed. Each inner segment 34 has a slit 46, which extends in a generally horizontal direction when the carrier stock 10 is unstressed, and which facilitates folding of such inner segment 34 when the carrier stock 10 is applied to the containers 12.

It is convenient to refer to the cross segments 36 at the opposite ends of such carrier 20 as terminal cross segments and to refer to the cross segments 38 located therebetween as medial cross segments.

Figure 3:
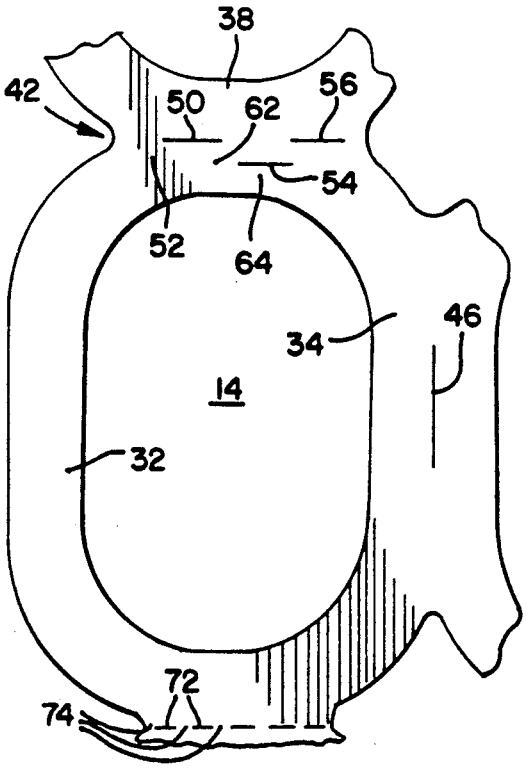
FIG. 3 is an enlarged, fragmentary, plan view of a portion of the carrier, as comprised in the carrier stock.

As shown in FIGS. 2 and 3, each medial cross segment 38 is joined integrally at its outer end to two outer segments so as to define a generally Y-shaped junction with a crotch 42 narrowing generally toward a transverse midline of such medial cross segment 38. The transverse midline of each medial cross segment 38 divides such medial cross segment 38 into two half segments. At its inner end, each medial cross segment 38 is joined integrally to two inner segments 34 so as to define a generally Y-shaped junction at one of the smaller apertures 22.

Near its outer end, each medial cross segment 38 has a primary slit 50 extending substantially along the transverse midline of such cross segment 38 and being spaced from the crotch 42 of such cross segment 38 by a frangible bridge 52 formed of the sheet material. Whichever of the half segments of such medial cross segment 38 is nearer an end of the carrier 20 has a secondary slit 54 extending transversely. Near its inner end, each medial cross segment 38 has a tertiary slit 56, which is aligned transversely with the primary slit 50. The tertiary slit 56, which is disposed between the primary slit 50 and the nearest aperture 22, serves to further weaken such cross segment 38.

In each medial cross segment 38, the primary slit 50 is spaced from the secondary slit 54 by a frangible bridge 62 formed of the sheet material Moreover, the secondary slit 54 is spaced from the nearer aperture 14 by a frangible bridge 64 formed of the sheet material.

Also, as shown in FIG. 2, each terminal cross section 36 has a transverse midline having a series of slits 72 between transverse bridges 74. The slits 72 and transverse bridges 74 enable each terminal cross segment 36 to be easily severed along its transverse midline.

At each carrier 20, the carrier stock 10 has an integral handle 80 having two opposite legs 82 and a middle leg 84. The legs 82, 84, are joined respectively to successive outer segments 30 of such carrier 20. The middle leg 84 has a slit 86 to facilitate breaking the middle leg 84. As shown in FIG. 1, the handle 80 is folded downwardly when the carrier stock 10 is applied to the containers 12. Therefore, the handle 80 does not interfere with the cross sections of the carrier stock 10 being severed, as described below.

Thus, in many respects the carrier stock 10 is similar to the carrier stock disclosed in Klygis et al. U.S. Pat. No. 5,115,910. This invention contemplates that the carrier stock disclosed therein may be alternatively used.

In FIGS. 5 and 6, two star wheels 100 are shown. Except as illustrated and described herein, the star wheels 100 are similar to the star wheels disclosed in prior patents including Creed et al. U.S. Pat. No. 3,204,386 and Schlueter U.S. Pat. No. 3,991,640, the disclosures of which are incorporated herein by reference. The star wheels 100 are components of machines (not otherwise shown) similar to the machines disclosed in those patents.

Each star wheel 100 is mounted for rotation about a vertical axis on one side of the rows of containers 12 having the carrier stock 10 applied thereto. Each star wheel 100 has a circumferential array of concave pockets 102 conforming generally to the cylindrical side wall of such a container 12. The concave pockets 102 are separated by radial projections 104. As the containers 12 having the carrier stock 10 applied thereto move through the machine comprising the star wheels 100, the star wheels 100 are rotated, and successive containers 12 are received in successive pockets 102 of the star wheels 100. Adjacent pockets 102 of the star wheels 100 are spaced so that the cross segments 36, 38, of the carrier stock 10 are stretched slightly in a longitudinal direction (i.e. along the carrier stock 10) as the containers 12 having the carrier stock 10 applied thereto pass between the star wheels 100.

Each star wheel 100 carries two sets of knife assemblies, namely a set of knife assemblies 110, each having a relatively long, radially extending knife 112 with a sharpened, vertical, outer edge 114, and a set of knife assemblies 120, each having a relatively short, radially extending knife 122 with a sharpened, vertical, outer edge 124. The knife assemblies 110, 120, are arranged around the star wheels 100 so that pairs of adjacent knife assemblies 120 comprising relatively short knives 122 alternate with single knife assemblies 110 comprising relative long knives 112. The relatively long knives 112 are used to sever the terminal band segments 36 completely, each being severed along its transverse midline, between one of the opposite edges of the carrier stock 10 and one of the smaller apertures 22. The relatively short knives 122 are used to sever the medial band segments 36 partially, each being severed from one of the opposite edges of the carrier stock 10, over approximately one third to approximately half of its transverse midline.

Each star wheel 100 has a knife-moving mechanism (not shown) associated with each knife assembly of such star wheel 100 for moving the knife of such knife assembly radially inwardly and radially outwardly in a reciprocating manner. The knife-moving mechanisms are similar to the knife-moving mechanisms disclosed in Creed et al. U.S. Pat. No. 3,204,386.

The star wheels 100 are arranged so that, as the containers 12 having the carrier stock 10 applied thereto advance between the star wheels 100 and the star wheels 100 rotate, successive knives around the star wheels 100 are moved by the aforenoted mechanisms so that their sharpened edges engage at successive crotches 42 along the opposite edges of the carrier stock 10 and so that such knives cut transversely into successive cross segments at the respective crotches 42 at the opposite edges of the carrier stock 10. Thus, each terminal cross segment 36 is severed completely along its transverse midline, between one of the opposite edges of the carrier stock 10 and one of the smaller apertures 22, so as to sever the packages P (each comprising six containers 12 and a carrier 20 severed from the carrier stock 10) from one another. Also, each medial cross segment 38 is severed partially, from the crotch 42 at one of the opposite edges of the carrier stock 10, over approximately one half of its transverse midline.

When each medial cross segment 38 is severed partially, as described above, its frangible bridge 52 is severed completely, whereas its other frangible bridges including its frangible bridges 62, 64, are left unsevered. Thus, a tear-initiating slit S (see FIGS. 1, 4, and 6) is formed, which includes the primary slit 50. The tear-initiating slit S extends over approximately one third to approximately one half of the transverse midline, preferably over approximately one half of the transverse midline.

Figure 4:
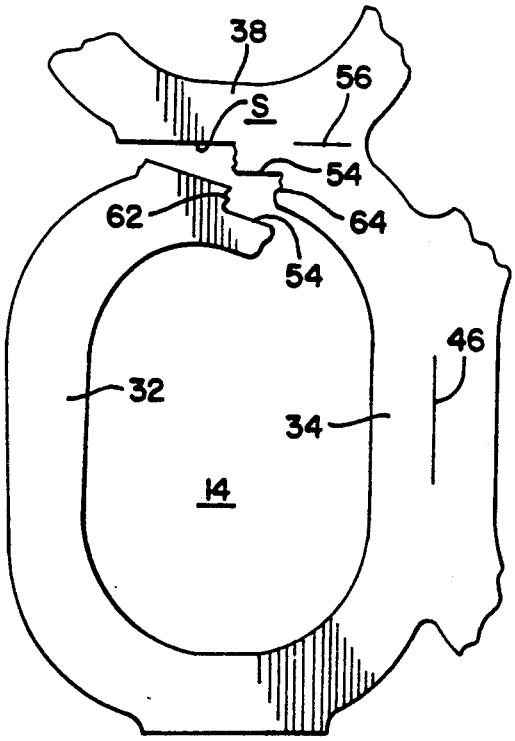
FIG. 4 is a similar view of the same portion, after the carrier has been used.

As shown in FIG. 4, a tear in a medial cross segment 38 propagates from the tear-initiating slit S, through the frangible bridge 62, into the secondary slit 54 and from the secondary slit 54, through the frangible bridge 64, into one of the container-receiving apertures 14. Thus, the tear propagates wholly within the medial cross segment 38, into one of the container-receiving apertures 14.

Because the medial cross segments can be so torn, it is easy to remove the end containers 12 of the package P from the carrier 20. To remove such a container 12, two adjacent containers 12 are manipulated by separating their lower ends manually while using their upper ends as a fulcrum where their upper ends abut near their chimes 16, so as to stress the medial cross segments 38 between the containers 12 being manipulated.

Various modifications may be made in the preferred embodiment described above without departing from the scope and spirit of this invention.

I claim:

1. A method of forming packages from substantially identical containers having cylindrical side walls and from carrier stock formed from a single sheet of resilient polymeric material and having two opposite edges, the carrier stock being severable transversely to form individual carriers, each carrier having band segments defining container-receiving apertures in a rectangular array with longitudinal rows and transverse ranks, each carrier also having additional apertures, said band segments including terminal cross segments at opposite ends of successive carriers, each terminal cross segment having a transverse midline, said band segments also including medial cross segments separating the container-receiving apertures in each longitudinal row along the opposite edges of each carrier, each medial cross segment having a transverse midline and extending between one of the opposite edges and one of the additional apertures, the containers being arranged in a rectangular array comprising longitudinal rows and transverse ranks and being applied to the containers so that the containers are received in the container-receiving apertures and so that the band segments engage the cylindrical side walls of the containers, the method comprising steps of (a) severing each terminal cross segment at one end of one such carrier completely along its transverse midline, (b) severing each medial cross segment of the same carrier partially along its transverse midline, from one of the opposite edges, so as to form a tear-initiating slit extending for a substantial distance along the transverse midline of such medial cross segment, and (c) severing each terminal cross segment at the other end of the same carrier completely along its transverse midline.

2. The method of claim 1 wherein each medial cross segment is severed so that its tear-initiating slit extends along approximately one third to approximately one half of its transverse midline.

3. The method of claim 1 wherein the severing steps are effected so as to sever the terminal cross segment at one such end of each carrier before severing the medial cross segments of such carrier and so as to sever the medial cross segments of such carrier before severing the terminal cross segment at the other end of such package.

4. The method of claim 1 wherein the severing steps are effected by moving knives transversely into the carrier stock, from the opposite edges, toward the additional apertures.

5. The method of claim 1 wherein each medial cross segment includes a primary slit extending along its transverse midline and is severed partially along its transverse midline, from one of the opposite edges, so as to form the tear-initiating slit, which includes the primary slit.

* * * * *